US008286796B2

(12) United States Patent
Yu

(10) Patent No.: US 8,286,796 B2
(45) Date of Patent: Oct. 16, 2012

(54) SATELLITE ANTENNA PACKAGE

(75) Inventor: Pei-Shan Yu, Taipei Hsien (TW)

(73) Assignee: Wistron NeWeb Corp., Hsinchu (TW)

( * ) Notice: Subject to any disclaimer, the term of this patent is extended or adjusted under 35 U.S.C. 154(b) by 532 days.

(21) Appl. No.: 12/625,353

(22) Filed: Nov. 24, 2009

(65) Prior Publication Data

US 2011/0005965 A1 Jan. 13, 2011

(30) Foreign Application Priority Data

Jul. 9, 2009 (TW) ..... 98123179 A

(51) Int. Cl.
*B65D 69/00* (2006.01)

(52) U.S. Cl. ..... 206/576; 206/320; 206/723; 206/587

(58) Field of Classification Search ..... 206/521, 206/320, 723, 587, 576, 701, 702, 722, 724, 206/725, 591, 592, 595, 594, 585
See application file for complete search history.

(56) References Cited

U.S. PATENT DOCUMENTS

| | | | | |
|---|---|---|---|---|
| 6,237,795 | B1 * | 5/2001 | Buckley et al. | 220/1.5 |
| 6,321,911 | B1 * | 11/2001 | Raimer et al. | 206/509 |
| 6,405,873 | B2 * | 6/2002 | Koike | 206/592 |
| 6,450,340 | B1 * | 9/2002 | Hino et al. | 206/459.5 |
| 6,942,099 | B1 * | 9/2005 | Wang | 206/521 |
| 6,976,587 | B2 * | 12/2005 | Liverman et al. | 206/586 |
| 6,991,097 | B1 * | 1/2006 | Sheehan | 206/223 |
| 7,775,021 | B2 * | 8/2010 | Lin | 53/445 |
| 7,780,010 | B2 * | 8/2010 | Kinuhata | 206/722 |
| 2003/0213725 | A1 * | 11/2003 | Koike | 206/588 |
| 2004/0094448 | A1 * | 5/2004 | Koike | 206/521 |
| 2006/0108255 | A1 * | 5/2006 | Chu | 206/521 |

* cited by examiner

*Primary Examiner* — Jacob K Ackun
*Assistant Examiner* — Jenine Pagan

(57) ABSTRACT

A satellite antenna package is provided. The satellite antenna package includes a receiving structure, an antenna device and a cable. A recess and a groove are formed on the receiving structure, and the recess communicates with the groove. The antenna device is disposed in the recess. The cable connects to the antenna device, wherein the cable is connected with the antenna device and partially disposed in the groove, travels along an edge of the receiving structure, and surrounds the antenna device.

21 Claims, 5 Drawing Sheets

100

SATELLITE ANTENNA PACKAGE

CROSS REFERENCE TO RELATED APPLICATIONS

This application claims priority of Taiwan Patent Application No. 098123179, filed on Jul. 9, 2009, the entirety of which is incorporated by reference herein.

BACKGROUND OF THE INVENTION

1. Field of the Invention

The present invention relates to a satellite antenna package, and in particular relates to a smaller sized satellite antenna package.

2. Description of the Related Art

For conventional satellite antenna packages, a device body of a satellite antenna device and a cable thereof are packaged separately. The device body is packaged with packaging material such as cardboard or Styrofoam and the cable is bent, tied up and packaged separately. Because the device body and cable are individually packaged, required space for both, is relatively large; thus, increasing costs for transmitting conventional satellites using the same. Additionally, if the packaged cable is over bent, strength of the cable at the over bent section is weakened. Specifically; breakage occurs more frequently for cables with over bent sections than those with correctly bent sections.

BRIEF SUMMARY OF THE INVENTION

A detailed description is given in the following embodiments with reference to the accompanying drawings.

A satellite antenna package is provided. The satellite antenna package includes a receiving structure, antenna devices and cables. A plurality of recesses and a plurality of grooves are formed on the receiving structure. The recesses respectively communicate with the grooves. The antenna devices are disposed in the recesses. The cables are connected to the antenna devices, wherein each cable is connected with the antenna device partially disposed in the groove, travels along an edge of the receiving structure, and surrounds the antenna devices.

In the embodiment of the invention, the cables are received in the space formed between the antenna devices exposed above the receiving structure and the inner wall of a box. Therefore, no cable package is required, decreasing required space when compared to conventional methods. As well, the cables travel along the edge of the receiving structure to surround the antenna devices. Thus, weakening of the cables at bent sections is prevented, as the cables are not bent but curved with a large radius.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
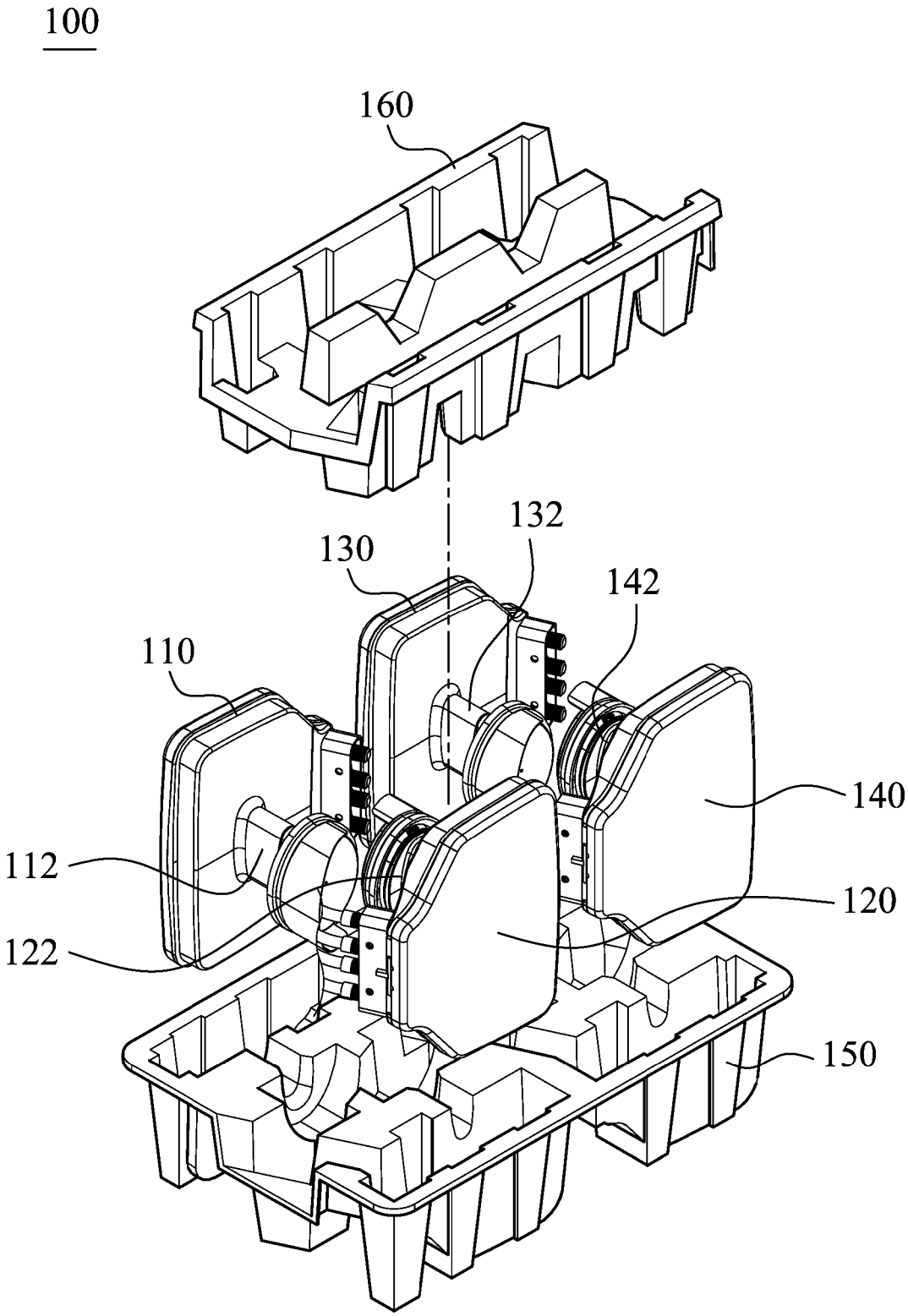
FIG. 1 is an exploded view of a satellite antenna package of an embodiment of the invention.

FIG. 1 is an exploded view of a satellite antenna package 100 of an embodiment of the invention. The satellite antenna package 100 comprises a first antenna device 110, a second antenna device 120, a third antenna device 130, a fourth antenna device 140, a receiving structure 150 and a supporting structure 160.

Figure 2A:
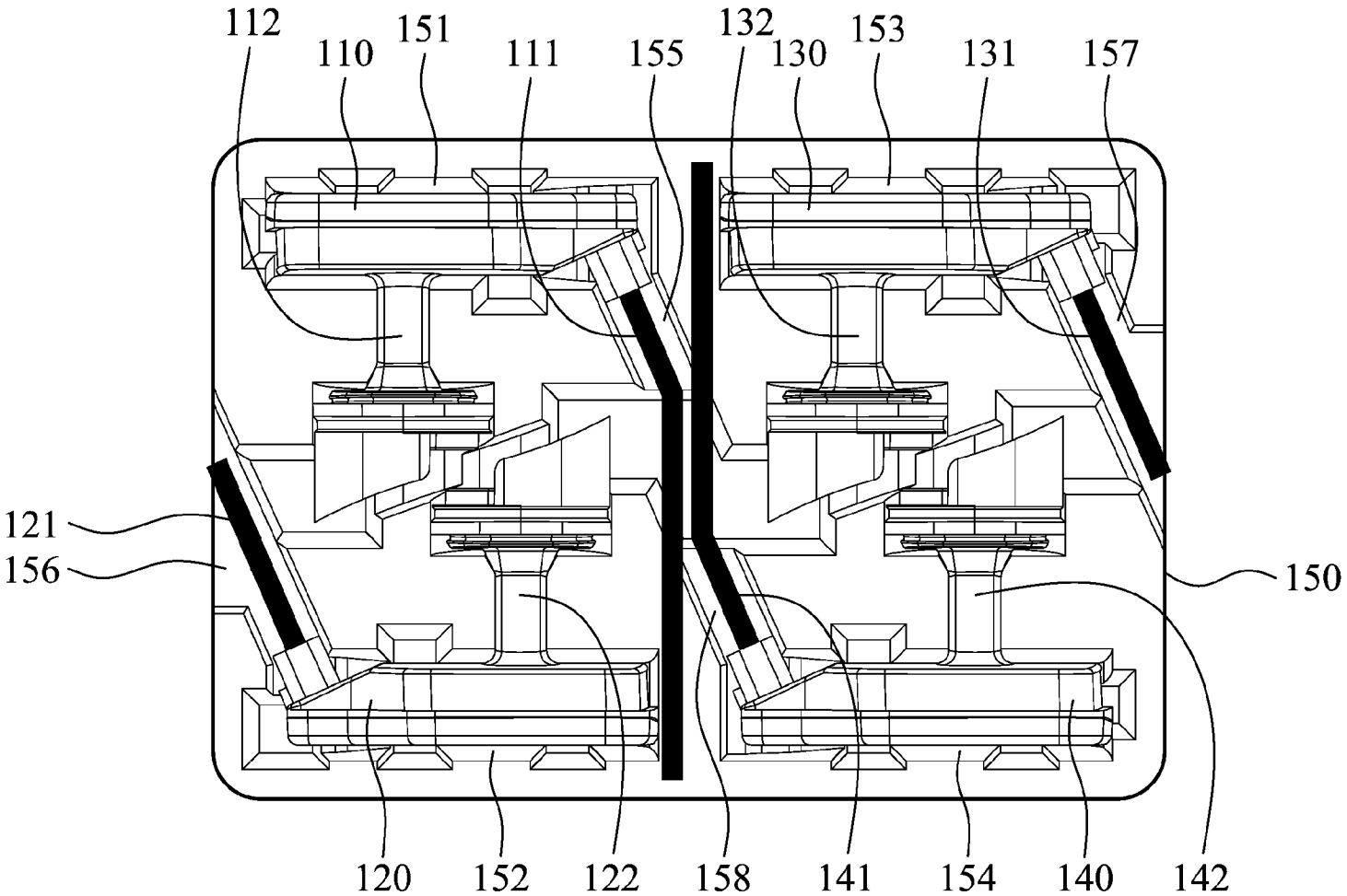
FIG. 2*a* is a top view showing antenna devices disposed in a receiving structure.
Figure 2B:
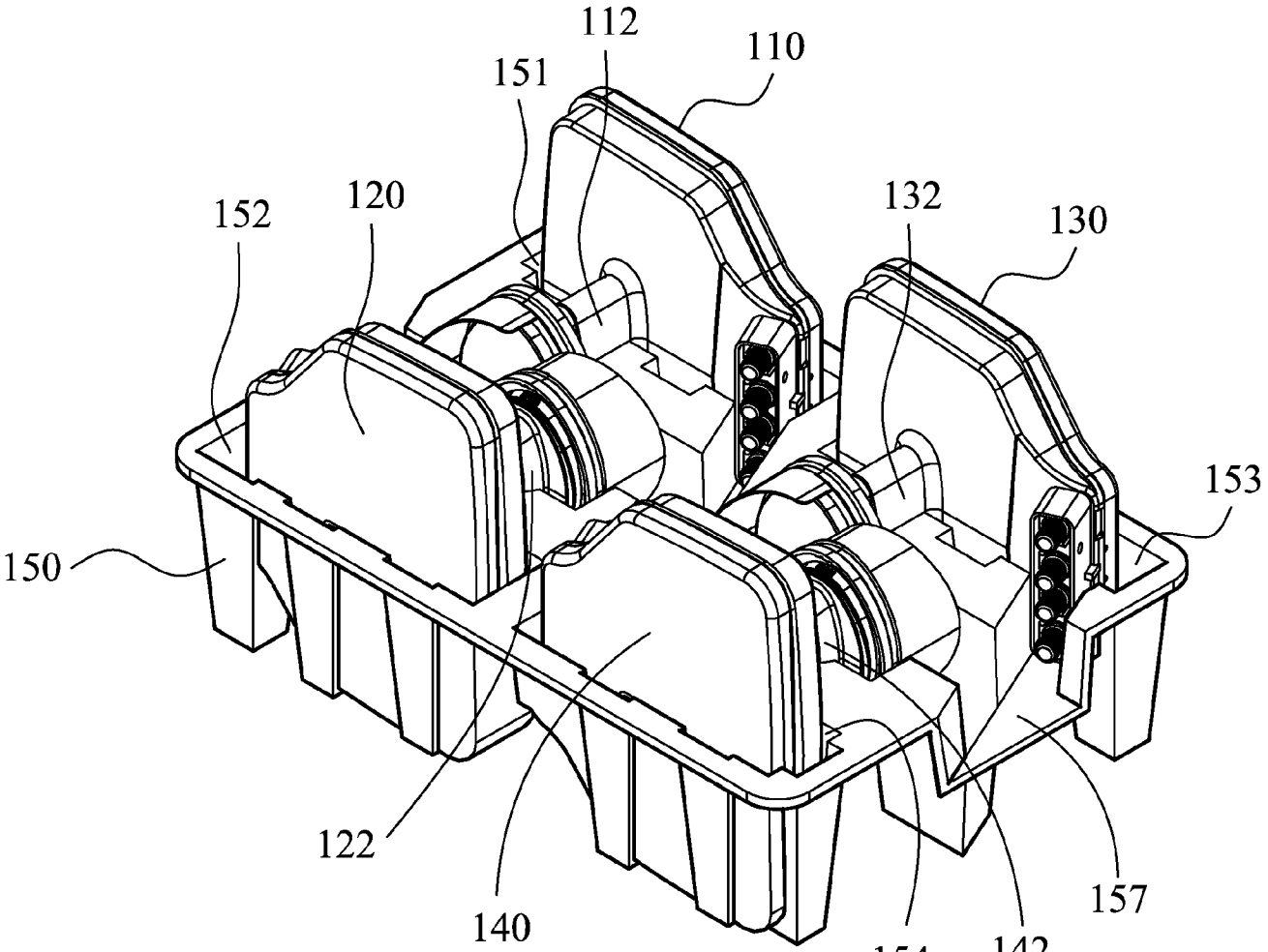
FIG. 2*b* is a perspective view showing antenna devices disposed in the receiving structure.

With reference to FIGS. 2*a* and 2*b*, a first recess 151, a second recess 152, a third recess 153, a fourth recess 154, a first groove 155, a second groove 156, a third groove 157 and a fourth groove 158 are formed on the receiving structure 150. The first recess 151 corresponds to the second recess 152, and the third recess 153 corresponds to the fourth recess 154. The first recess 151 communicates with the first groove 155, the second recess 152 communicates with the second groove 156, the third recess 153 communicates with the third groove 157, and the fourth recess 154 communicates with the fourth groove 158.

The first groove 155, the second groove 156, the third groove 157 and the fourth groove 158 are parallel to each other. The first groove 155 and the fourth groove 158 are aligned in a straight line.

The first antenna device 110 is disposed in the first recess 151. The second antenna device 120 is disposed in the second recess 152. The third antenna device 130 is disposed in the third recess 153. The fourth antenna device 140 is disposed in the fourth recess 154.

A first cable 111 connects to the first antenna device 110, and the first cable 111 is connected with the first antenna device 110 and passing through the first groove 155. A second cable 121 connects to the second antenna device 120, and the second cable 121 is connected with the second antenna device 120 and partially disposed in the second groove 156. A third cable 131 connects to the third antenna device 130, and the third cable 131 is connected with the third antenna device 130 and partially disposed in the third groove 157. A fourth cable 141 connects to the fourth antenna device 140, and the fourth cable 141 is connected with the fourth antenna device 140 and partially disposed in the fourth groove 158.

The first antenna device 110 has a first wave guide 112, the second antenna device 120 has a second wave guide 122, the third antenna device 130 has a third wave guide 132, and the fourth antenna device 140 has a fourth wave guide 142. The first wave guide 112, the second wave guide 122, the third wave guide 132 and the fourth wave guide 142 are parallel to each other.

The first wave guide 112 and the second wave guide 122 are located between the first groove 155 and the second groove 156. The third wave guide 132 and the fourth wave guide 142 are located between the third groove 157 and the fourth groove 158. The first groove 155 and the fourth groove 158 are located between the second wave guide 122 and the third wave guide 132.

Figure 3:
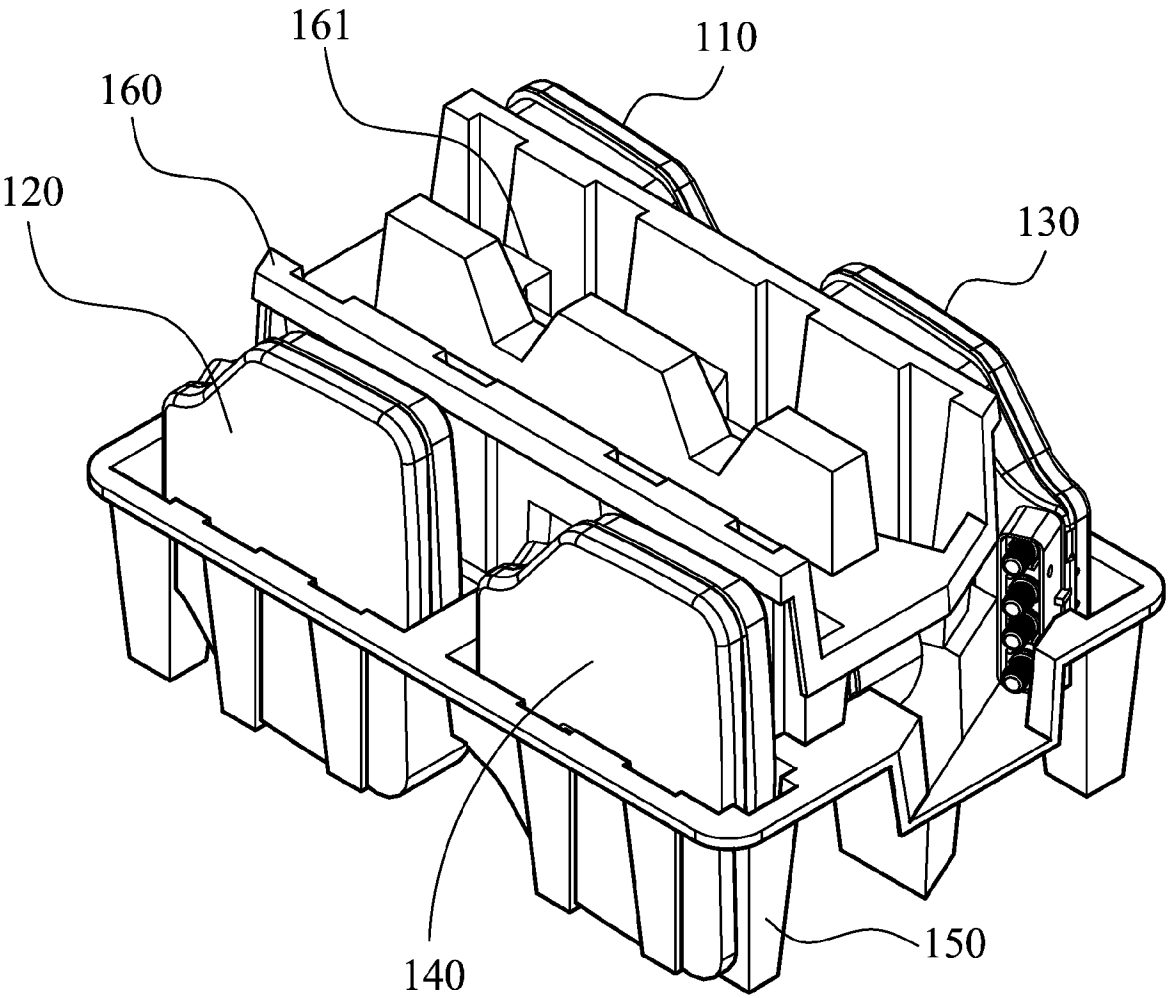
FIG. 3 is a perspective view showing a supporting structure disposed on the receiving structure.

With reference to FIGS. 1 and 3, the supporting structure 160 abuts the receiving structure 150. The first wave guide 112, the second wave guide 122, the third wave guide 132 and the fourth wave guide 142 are sandwiched between the supporting structure 160 and the receiving structure 150. A receiving groove 161 is formed on the supporting structure 160.

Figure 4:
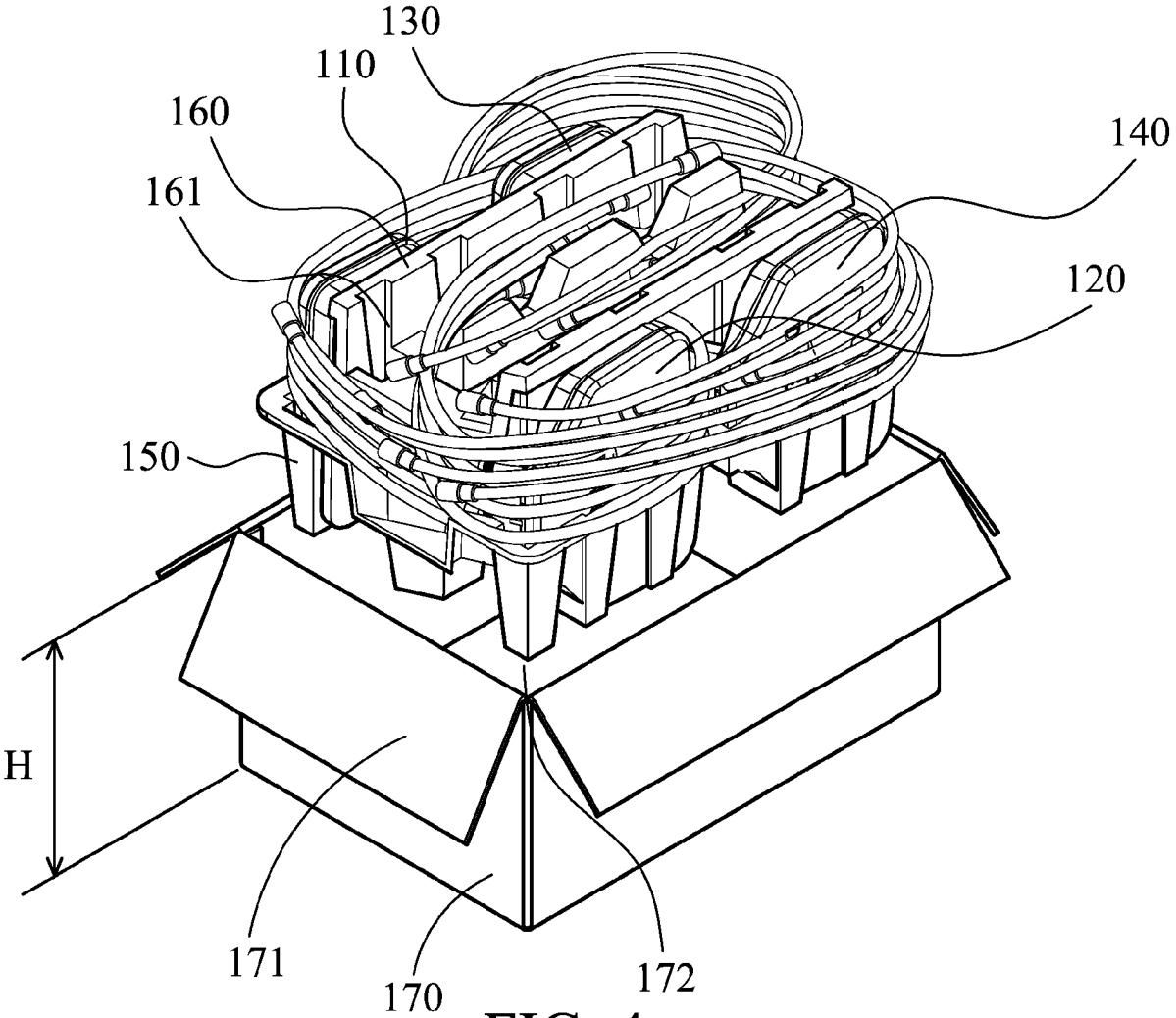
FIG. 4 shows a complete satellite antenna package of the embodiment of the invention.

FIG. 4 shows a complete satellite antenna package 100 of the embodiment of the invention, wherein the satellite antenna package 100 further comprises a box 170. The first antenna device 110, the second antenna device 120, the third antenna device 130, the fourth antenna device 140, the receiving structure 150 and the supporting structure 160 are received in the box 170. The box 170 has a bottom surface 172 and a top surface 171. The receiving structure 150 abuts the bottom surface 172. The supporting structure 160 abuts the top surface 171. The supporting structure 160, the receiving structure 150 and the box 170 thus compose an integral structure to resist external forces.

A box height H is formed between the bottom surface 172 and the top surface 171. A height of the receiving structure 150 is about half that of the box height H. Therefore, the cables are received in a space formed between the antenna devices exposed above the receiving structure 150 and an inner wall of the box. The first cable 111, the second cable 121, the third cable 131 and the fourth cable 141 travel along an edge of the receiving structure 150, and surround the first antenna device 110, the second antenna device 120, the third antenna device 130 and the fourth antenna device 140. In one embodiment, the first cable 111, the second cable 121, the third cable 131 and the fourth cable 141 are partially extended in the receiving groove 161.

In the embodiment of the invention, the cables are received in the space formed between the antenna devices exposed above the receiving structure and the inner wall of the box. Therefore, no cable package is required, decreasing required space when compared to conventional methods. As well, the cables travel along the edge of the receiving structure to surround the antenna devices. Thus, weakening of the cables at bent sections is prevented, as the cables are not bent but curved with a large radius.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A satellite antenna package, comprising:

a receiving structure, wherein a first recess, a second recess, a first groove and a second groove are formed on the receiving structure, the first recess communicates with the first groove, and the second recess communicates with the second groove;

a first antenna device, disposed in the first recess;

a second antenna device, disposed in the second recess;

a first cable, connected to the first antenna device, wherein the first cable is connected with the first antenna device and partially disposed in the first groove, travels along an edge of the receiving structure, and surrounds the first antenna device and the second antenna device; and a second cable, connected to the second antenna device, wherein the second cable is connected with the second antenna device and partially disposed in the second groove, travels along the edge of the receiving structure, and surrounds the first antenna device and the second antenna device.

2. The satellite antenna package as claimed in claim 1, wherein the first groove is parallel to the second groove.

3. The satellite antenna package as claimed in claim 1, further comprising a supporting structure, wherein the supporting structure is disposed on the receiving structure, and the first antenna device and the second antenna device are partially sandwiched between the supporting structure and the receiving structure.

4. The satellite antenna package as claimed in claim 3, wherein a receiving groove is formed on the supporting structure, and the first cable and the second cable are partially extended in the receiving groove.

5. The satellite antenna package as claimed in claim 3, further comprising a box, wherein the receiving structure, the first antenna device, the second antenna device, the first cable, the second cable and the supporting structure are received in the box, the box has a bottom surface and a top surface, the receiving structure abuts the bottom surface, and the supporting structure abuts the top surface.

6. The satellite antenna package as claimed in claim 5, wherein a box height is formed between the bottom surface and the top surface, and a height of the receiving structure is about half that of the box height.

7. The satellite antenna package as claimed in claim 1, wherein the first antenna device has a first wave guide, the second antenna device has a second wave guide, and the first wave guide is parallel to the second wave guide.

8. The satellite antenna package as claimed in claim 7, wherein the first wave guide and the second wave guide are located between the first groove and the second groove.

9. The satellite antenna package as claimed in claim 1, wherein a third recess, a fourth recess, a third groove and a fourth groove are formed on the receiving structure, the third recess communicates with the third groove, and the fourth recess communicates with the fourth groove, and the satellite antenna package further comprising:

a third antenna device, disposed in the third recess;

a fourth antenna device, disposed in the fourth recess;

a third cable, connected to the third antenna device, wherein the third cable is connected with the third antenna device and partially disposed in the third groove, travels along the edge of the receiving structure, and surrounds the first antenna device, the second antenna device, the third antenna device and the fourth antenna device; and a fourth cable, connected to the fourth antenna device, wherein the fourth cable is connected with the fourth antenna device and partially disposed in the fourth groove, travels along the edge of the receiving structure, and surrounds the first antenna device, the second antenna device, the third antenna device and the fourth antenna device.

10. The satellite antenna package as claimed in claim 9, wherein the third groove is parallel to the fourth groove, and the first groove and the fourth groove are aligned in a straight line.

11. The satellite antenna package as claimed in claim 9, further comprising a supporting structure, wherein the supporting structure is disposed on the receiving structure, and the first antenna device, the second antenna device, the third antenna device and the fourth antenna device are partially sandwiched between the supporting structure and the receiving structure.

12. The satellite antenna package as claimed in claim 9, wherein the first antenna device has a first wave guide, the second antenna device has a second wave guide, the third antenna device has a third wave guide, the fourth antenna device has a fourth wave guide, and the first wave guide, the second wave guide, the third wave guide and the fourth wave guide are parallel to each other.

13. The satellite antenna package as claimed in claim 12, wherein the first wave guide and the second wave guide are located between the first groove and the second groove, and the third wave guide and the fourth wave guide are located between the third groove and the fourth groove.

14. The satellite antenna package as claimed in claim 13, wherein the first groove and the fourth groove are located between the second wave guide and the third wave guide.

15. The satellite antenna package as claimed in claim 9, wherein the first cable and the second cable travel along the edge of the receiving structure, and surround the first antenna device, the second antenna device, the third antenna device and the fourth antenna device.

16. A satellite antenna package for packing a first antenna device and a second antenna device, wherein the first antenna device has a first cable, and the second antenna device has a second cable, comprising:

a receiving structure, wherein a first recess, a second recess, a first groove and a second groove are formed on the receiving structure, the first recess communicates with the first groove, the second recess communicates with the second groove, the first antenna device is disposed in the first recess, the second antenna device is disposed in the second recess, the first cable connects to the first antenna device, the first cable is connected with the first antenna device and partially disposed in the first groove, the second cable connects to the second antenna device, and the second cable is connected with the second antenna device and partially disposed in the second groove;

a supporting structure, disposed on the receiving structure, wherein the first antenna device and the second antenna device are partially sandwiched between the supporting structure and the receiving structure; and a box, wherein the receiving structure, the first antenna device, the second antenna device, the first cable, the second cable and the supporting structure are received in the box, the box has a bottom surface and a top surface, the receiving structure abuts the bottom surface, and the supporting structure abuts the top surface.

17. The satellite antenna package as claimed in claim 16, wherein the first cable and the second cable travel along the edge of the receiving structure, and surround the first antenna device and the second antenna device.

18. The satellite antenna package as claimed in claim 16, wherein the first groove is parallel to the second groove.

19. The satellite antenna package as claimed in claim 16, wherein a box height is formed between the bottom surface and the top surface, and a height of the receiving structure is about half that of the box height.

20. The satellite antenna package as claimed in claim 16, wherein the first antenna device has a first wave guide, the second antenna device has a second wave guide, the first wave guide is parallel to the second wave guide, and the first wave guide and the second wave guide are located between the first groove and the second groove.

21. A satellite antenna package, comprising:

a receiving structure, wherein a recess and a groove are formed on the receiving structure, and the recess communicates with the groove;

an antenna device, disposed in the recess; and a cable, connected to the antenna device, wherein the cable is connected with the antenna device and partially disposed in the groove, travels along an edge of the receiving structure, and surrounds the antenna device.

* * * * *